US006272817B1

(12) United States Patent
Fürther

(10) Patent No.: US 6,272,817 B1
(45) Date of Patent: Aug. 14, 2001

(54) SADDLECLOTH WITH ATTACHMENT TO A RIDING SADDLE

(76) Inventor: Walter Fürther, Eichenstrasse 1, 85849 Hofolding (DE)

( * ) Notice: Subject to any disclaimer, the term of this patent is extended or adjusted under 35 U.S.C. 154(b) by 0 days.

(21) Appl. No.: 09/396,013

(22) Filed: Sep. 15, 1999

(30) Foreign Application Priority Data

Sep. 29, 1998 (DE) ..... 298 17 422 U

(51) Int. Cl.[7] ..... B68C 1/12; B68C 1/02
(52) U.S. Cl. ..... 54/44.1; 54/66
(58) Field of Search ..... 54/44.1, 44.5, 54/44.7, 66

(56) References Cited

U.S. PATENT DOCUMENTS 3,971,194 * 7/1976 Morgan ..... 54/66
4,905,458 * 3/1990 Johnston et al. ..... 54/44.1 X
5,423,164 * 6/1995 Schneider ..... 54/66 X

FOREIGN PATENT DOCUMENTS 28 21 475 11/1979 (DE) .

* cited by examiner

*Primary Examiner*—Robert P. Swiatek
(74) *Attorney, Agent, or Firm*—Henry M. Feiereisen; Ursula B. Day

(57) ABSTRACT

A saddlecloth includes an external cloth portion having at least one attachment member for cooperation with a complementary attachment member on an inside surface of a saddle, with the at least one attachment member of the saddlecloth and the complementary attachment member of the riding saddle forming a Velcro-type fastener. An additional attachment member may be arranged on the outside of each side member of the saddlecloth in substantial parallel relationship to the front edge of the saddlecloth for cooperation with a complementary further attachment member on the inside of the saddle flaps, with the additional attachment member and the complementary further attachment member forming a Velcro-type fastener.

9 Claims, 2 Drawing Sheets

SADDLECLOTH WITH ATTACHMENT TO A RIDING SADDLE

CROSS-REFERENCES TO RELATED APPLICATIONS

This application claims the priority of German Patent Application Serial No. 298 17 422.7, filed Sep. 29, 1998, the subject matter of which is incorporated herein by reference.

BACKGROUND OF THE INVENTION

The present invention relates to a saddlecloth with attachment to a riding saddle.

When saddling a horse, a saddlecloth is utilized for placing it on the back of a horse underneath the saddle to form a stable and secure buffer between the horse and the saddle and to thereby avoid a direct contact of the saddle leather with the body of the horse. Conventional saddlecloths are provided with loops that are either placed at the lower edge of the saddlecloth for insertion of the girth and/or located on each side at the front edge of the saddlecloth of the saddle for insertion of the girth straps of the saddle.

Typically, saddlecloths are utilized with saddles of a variety of different sizes so that the loops must be sufficiently sized. As a result, even when the horse has been saddled very carefully, the saddlecloth is thus prone to easily slide or form creases during riding. In both cases, pressure marks form very rapidly on the horse's back and lead to saddle sores. Also, as a consequence of its very limited flexibility, the riding saddle in conjunction with the rider's weight, is incapable to sufficiently adapt to the horse's back movement, so that the saddlecloth is pulled downwards, i.e. tightened across the horse's withers, causing chafing. Oftentimes, this chafing action leads to painful inflammation or even to open sores at the horse's withers, such that the horse requires medical treatment and thus is not available for riding purposes for an extended period.

SUMMARY OF THE INVENTION

It is thus an object of the present invention to provide an improved saddlecloth for attachment to a riding saddle, obviating the afore-stated drawbacks.

In particular, it is an object of the present invention to provide an improved saddlecloth for attachment to a riding saddle, preventing displacement or slippage of the saddlecloth with respect to the saddle or the horse during riding.

These objects, and others which will become apparent hereinafter, are attained in accordance with the present invention by providing a saddlecloth defining an upper or external cloth portion having at least one attachment member for cooperation with a complementary attachment member on an inside surface of a saddle, with the at least one attachment member of the saddlecloth and the complementary attachment member of the saddle forming a Velcro-type fastener.

Suitably, the attachment member of the saddlecloth is arranged along the centerline on the upper surface of the saddlecloth, preferably at least approximately over the entire length of the saddlecloth.

Optionally, each side portion of the saddlecloth may have on the outside a further attachment member of a Velcro-type fastener, with the further attachment member extending substantially parallel to a front edge of the saddlecloth.

In accordance with another aspect of the present invention, a riding saddle includes an internal saddle portion having at least one attachment member for cooperation with a complementary attachment member on an external surface of a saddlecloth, whereby the at least one attachment member of the saddle and the complementary attachment member of the saddlecloth form a Velcro-type fastener.

The riding saddle includes a pommel and a cantle, which together define a gullet therebetween, with the attachment member of the saddle extending along an apex line of the gullet. Suitably, the attachment member of the saddle may being arranged on an inside of the flaps or kneerolls of the saddle in substantial parallel relationship to a front edge of the flaps or kneerolls.

The present invention is also directed to a combination of a saddle and a saddlecloth, which is secured to the saddle by means of a Velcro fastener which, connects the apex line of the saddlecloth with the apex line of the gullet of the saddle.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
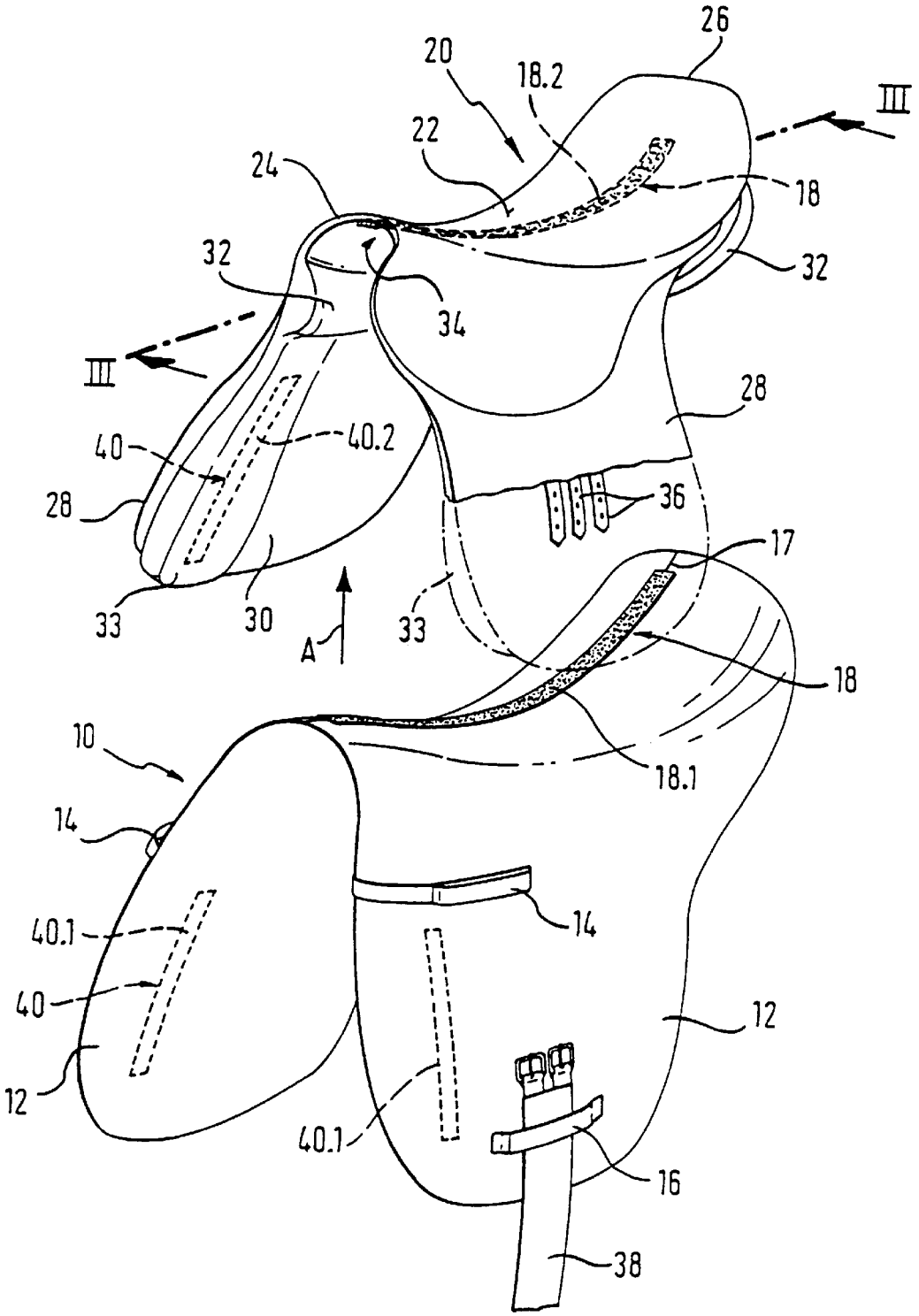
FIG. 1 is an exploded view of a riding saddle with a saddlecloth, in accordance with the present invention.

Throughout all the figures, same or corresponding elements are generally indicated by same reference numerals.

Turning now to the drawing, and in particular to FIG. 1, there is shown a riding saddle 20 having a pommel 24 and a cantle 26 which define a seat 22 therebetween. Depending downwardly from either side of the seat 22 are flaps 28, with kneerolls 30 being arranged underneath the flaps 28. Panels 33 are arranged on the kneerolls 30, and panels 32 extend from the pommel 24 to the cantle 26 for demarcating a saddle gullet 34. The panels 32 of the saddle 20 are resting on the horse's back on both sides of the spine to thereby avoid a contact of the saddle with the spinal processes of the horse. Located underneath the flaps 28 are tabs 36.

Secured in the apex of the gullet 34 of saddle 20, e.g. by gluing or sewing, is one attachment member 18.2 of a two-part hook and loop type fastener or Velcro fastener 18. The attachment member 18.2 may be formed in the shape of a band or strip, and extends preferably from the pommel 24 to the cantle 26.

Figure 2:
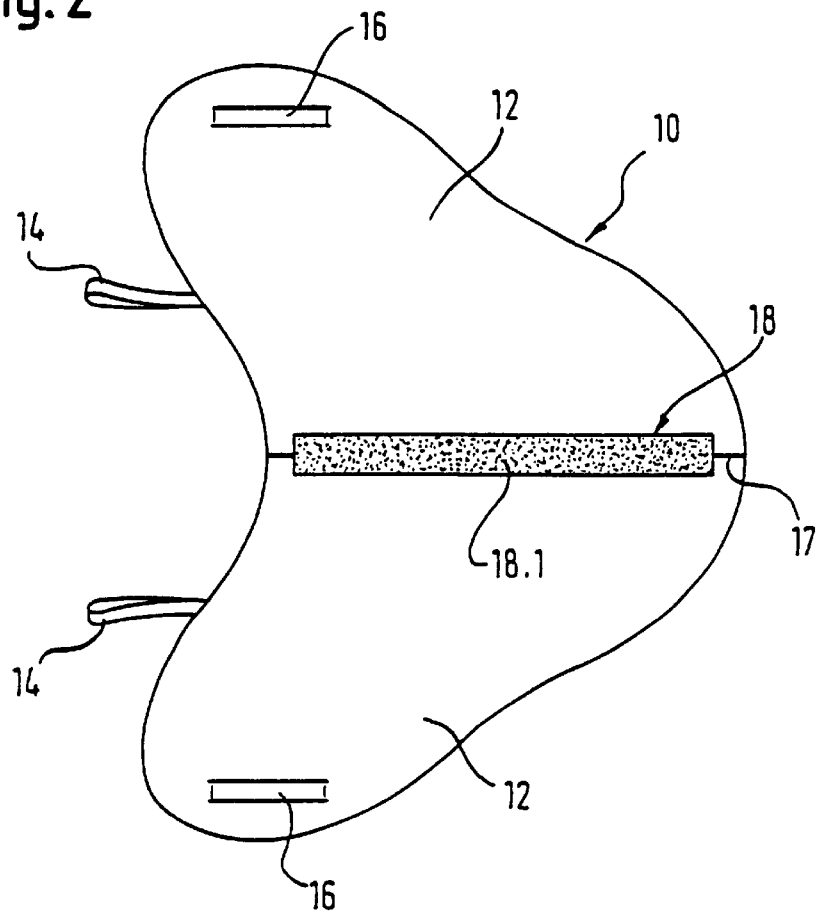
FIG. 2 is top view of the saddlecloth.

Positioned underneath the saddle 20 is a saddlecloth 10, which forms a buffer between the animal and the saddle 20. The saddlecloth 10 has side portions 12 which have each a front edge provided with loops 14 and a lower edge formed with loops 16 for the saddle girth 38. Secured, e.g. by gluing or sewing, along a center line 17 of the saddlecloth 10 is the other complementary attachment member 18.1 of the Velcro fastener 18, as shown in FIG. 2.

The securement of the saddlecloth 10 to the saddle 20 is realized by moving the saddlecloth 10 upwards in the direction of arrow A in FIG. 1 between the kneeroll 30 of the saddle 20, and pressing the complementary attachment members 18.1 and 18.2 of the Velcro fastener together along their entire length, thereby effecting a tight, stable and non-slip connection between the saddlecloth 10 and saddle 20. Even if little care is exercised when saddling the horse, crease formation in the saddlecloth 10 is virtually eliminated.

Figure 3:
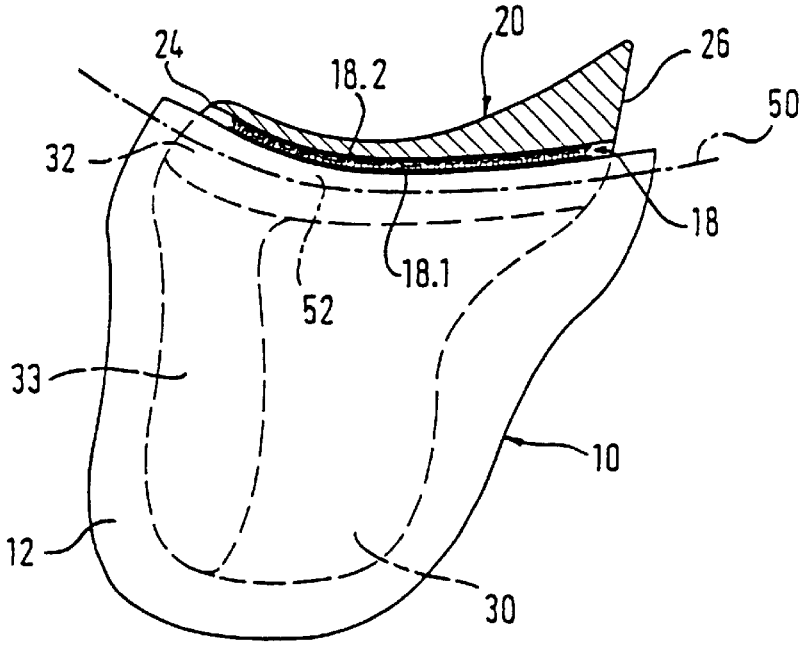
FIG. 3 is a sectional view of the saddlecloth and attached riding saddle, taken along the line III—III of FIG. 1.

As the saddlecloth 10 remains always connected along the center line 17 to the apex line of the gullet 34, the formation of a desired canal-like void 52 is realized between the upper line of the horse's back and the underside of the saddlecloth 10 in the region of the spine of the horse, as indicated by the broken line 50 in FIG. 3. The creation of such a void in this area has always been an objective for physiological reasons, because it permits air circulation. As a consequence of the securement of the saddlecloth 10 to the saddle 20 by the Velcro fastener 18, the saddlecloth 10 is prevented from slippage and formation of creases and cannot be pulled downwards and irritate the horse's withers.

In principle, it is even possible to now omit the conventional connections altogether, i.e. the lateral loops 14 and/or the girth loops 16. However, the equipment of the saddlecloth 10 with these loops has the added advantage that the side portions 12 of the saddlecloth 10 will not collapse onto each other after removal of the saddle 20 from the horse, so that placement of the saddle 20 upon a saddle rack is facilitated.

The conventional lateral loops 14 may, however, be substituted by a further Velcro fastener 40 provided on the outside of each side portion 12 of the saddlecloth 10, as indicated by broken lines in FIG. 1. These additional Velcro fasteners 40 are formed by an attachment member 40.1 on the respective side portion 12 and by a complementary attachment member 40.2 on the inside of the kneeroll 30 or saddle flaps 28. Securement of the attachment members 40.1, 40.2 may also be realized e.g. by gluing or sewing.

While the invention has been illustrated and described as embodied in a saddlecloth with attachment to a riding saddle, it is not intended to be limited to the details shown since various modifications and structural changes may be made without departing in any way from the spirit of the present invention.

What is claimed as new and desired to be protected by Letters Patent is set forth in the appended claims:

1. A saddlecloth, comprising an external cloth portion having at least one attachment member for cooperation with a complementary attachment member on an inside surface of a saddle, said at least one attachment member and said complementary attachment member forming a hook and loop fastener; wherein the cloth portion has an upper surface defining a centerline, said at least one attachment member of the cloth portion being arranged along the centerline on the upper surface of the cloth portion extending substantially along an entire length of the cloth portion.

2. The saddlecloth of claim 1, and further comprising side portions, each side portion defining an external surface having a further attachment member which extends substantially parallel to a front edge of the saddlecloth.

3. The riding saddle of claim 1, and further comprising a pommel and a cantle which together define a gullet therebetween, said at least one attachment member extending along an apex line of the gullet.

4. In combination:

a saddlecloth for placement on a horse or other animal, said saddlecloth defining an external cloth portion having at least one first attachment member; and a saddle for placement on the saddle cloth, said saddle defining an internal saddle portion having at least one second attachment member for cooperation with the at least one first attachment member, said at least one first and second attachment members forming a hook and loop fastener wherein the riding saddle includes a seat and flaps or kneerolls depending downwardly from either side of the seat, said at least one second attachment member being arranged on an inside of the flaps or kneerolls in substantial parallel relationship to a front edge of the flaps or kneerolls.

5. A riding saddle, comprising:

an internal saddle portion having at least one attachment member for cooperation with a complementary attachment member on an external surface of a saddlecloth, said at least one attachment member and said complementary attachment member forming a hook and loop fastener; and a seat and flaps or kneerolls depending downwardly from either side of the seat, said at least one attachment member being arranged on an inside of the flaps or kneerolls in substantial parallel relationship to a front edge of the flaps or kneerolls.

6. The combination of claim 5, wherein the cloth portion has an upper surface defining a centerline, said at least one first attachment member being arranged along the centerline on the upper surface of the cloth portion.

7. The combination of claim 5, wherein the saddlecloth has side portions, each side portion defining an external surface having a further attachment member which extends substantially parallel to a front edge of the saddlecloth.

8. The combination of claim 5, wherein the riding saddle includes a pommel and a cantle, which together define a gullet therebetween, said at least one second attachment member extending along an apex line of the gullet.

9. In combination:

a saddlecloth for placement on a horse or other animal, said saddlecloth defining an external cloth portion having at least one first attachment member; and a saddle for placement on the saddle cloth, said saddle defining an internal saddle portion having at least one second attachment member for cooperation with the at least one first attachment member, said at least one first and second attachment members forming a hook and loop fastener wherein the cloth portion has an upper surface defining a centerline, said at least one first attachment member being arranged along the centerline on the upper surface of the cloth portion and wherein the at least one first attachment member of the cloth portion extends substantially along an entire length of the cloth portion.

* * * * *